United States Patent [19]

Bortak et al.

[11] 3,960,699

[45] June 1, 1976

[54] SELF SUPPORTING ELECTRODES FOR CHLOR-ALKALI CELL

[75] Inventors: John J. Bortak, Plymouth; Edward N. Balko, Riverview; Albert J. Schweickart, Southgate; Stephen M. Collins, Trenton, all of Mich.

[73] Assignee: BASF Wyandotte Corporation, Wyandotte, Mich.

[22] Filed: Dec. 23, 1974

[21] Appl. No.: 535,321

[52] U.S. Cl. ..... 204/268; 204/280; 204/286

[51] Int. Cl.[2] ..... C25C 7/04; C25C 7/00

[58] Field of Search ..... 204/254, 256, 268, 280, 204/283, 284, 286, 269

[56] References Cited

UNITED STATES PATENTS

| | | | |
|---|---|---|---|
| 2,682,505 | 6/1954 | Greco | 204/284 |
| 3,824,173 | 7/1974 | Bouy et al. | 204/283 X |

*Primary Examiner*—John H. Mack
*Assistant Examiner*—A. C. Prescott
*Attorney, Agent, or Firm*—Bernhard R. Swick; Arnold S. Weintraub; Robert E. Dunn

[57] ABSTRACT

Segmented electrodes for use in electrolytic filter press cells obviate and reduce the problems of current distributions attributable to poor bipolar electrical connections, and electrode flatness. The electrodes are supported on the electrical boss as well as on the central barrier.

8 Claims, 3 Drawing Figures

SELF SUPPORTING ELECTRODES FOR CHLOR-ALKALI CELL

BACKGROUND OF THE INVENTION

1. Field of the Invention

The present invention pertains to electrolytic filter press cells. More particularly, the present invention pertains to bipolar electrolytic filter press cells. Even more particularly, the present invention pertains to improved electrodes for bipolar electrolytic filter press cells.

2. Prior Art

As is known to those skilled in the art to which the present invention pertains, the narrow electrode spacing requires the cathode and anode to be substantially flat and parallel to each other within close tolerances. Much has been disclosed in the prior art directed to means and methods for achieving this result. See, inter alia, U.S. Pat. Nos. 3,770,611; 3,755,105 and 3,824,173.

Another drawback in present day electrolytic filter press cells is represented by the electrical mechanical connections. Generally speaking these connections are achieved through a plurality of threaded fasteners which extend through bosses associated with adjacent cell anodes and cathodes and the separatory central web. Present day single cathode-anode constructions require a plurality of such bosses and their, respective, threaded connectors. However, this creates the problem of current differentials within the anode-cathode assembly caused by poor bipolar electrical connections. If the number of such electrical connections could be reduced then the problem of current distribution and differentials is reduced concommitantly.

Furthermore, if, while reducing this problem, the electrodes, per se, could be manufactured such that the narrow spacing tolerances could be maintained while holding and maintaining the flatness of the electrodes then a major advance in the art would be achieved.

SUMMARY OF THE INVENTION

In accordance with the present invention there is provided a segmented electrode assembly for a bipolar electrolytic filter press cell. The segments are oriented in a predetermined mode to minimize the problem of current differentials across adjacent cells. Further, each of the segments are substantially rectangular in shape.

Each of the long edges of each rectangular segment includes an inwardly directed bend which bears against the central web which divides adjacent cells, thereby providing support means for the electrode segments.

The bends or flanges, also, stiffen the electrode segment. This maintains the flatness of the electrode while enabling the maintenance of electrode spacing. This is important when considering the close tolerances desired between electrodes in bipolar filter press cells using separators to prevent puncture of the separators and poor current distribution and therefore hot spots.

For a more complete understanding of the present invention reference is made to the following detailed description and accompanying drawing. In the drawing like reference characters refer to like parts throughout the several views in which:

DESCRIPTION OF THE PREFERRED EMBODIMENTS

Figure 1:
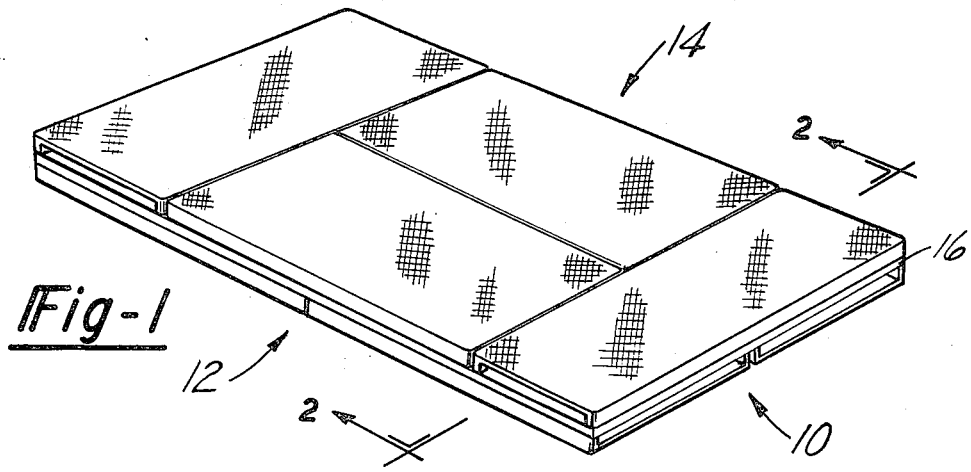
FIG. 1 is a perspective view of an electrolytic filter press cell assembly in accordance with the present invention.
Figure 2:
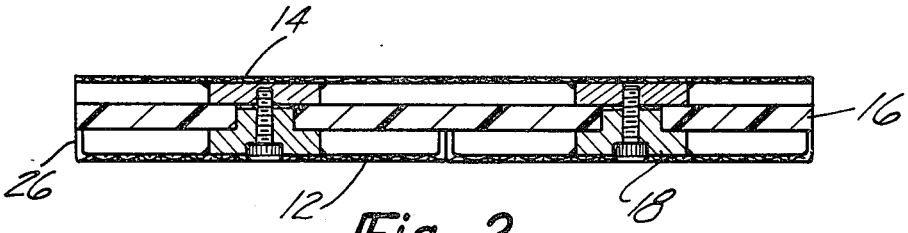
FIG. 2 is a fragmented cross-sectional view taken along the line 2—2 of FIG. 1.

Now with reference to the drawing there is depicted therein an electrolytic filter press cell assembly 10. The filter press cell 10 generally includes a first electrode 12 and a second electrode 14. Interposed between the electrodes 12, 14 is a central web or barrier 16. The electrodes are mechanically and electrically connected through a plurality of bosses 18 in any conventional manner, such as that described in U.S. Pat. Nos. 3,824,173; 3,752,757 and 3,788,966. In the ensuing discussion it is to be understood that these connections are made through the bosses.

In accordance herewith each of the electrodes 12, 14 comprises a plurality of segments 20, 22, respectively. For purposes of clarity, the electrode 12 will be referred to as the cathode and the electrode 14 as the anode.

The cathode segments 20 are each substantially rectangular and are arrayed in a first longitudinal orientation or direction. The orientation is such that each segment 20 has its electrical-mechanical connector-receiving apertures 24 longitudinally aligned.

Figure 3:
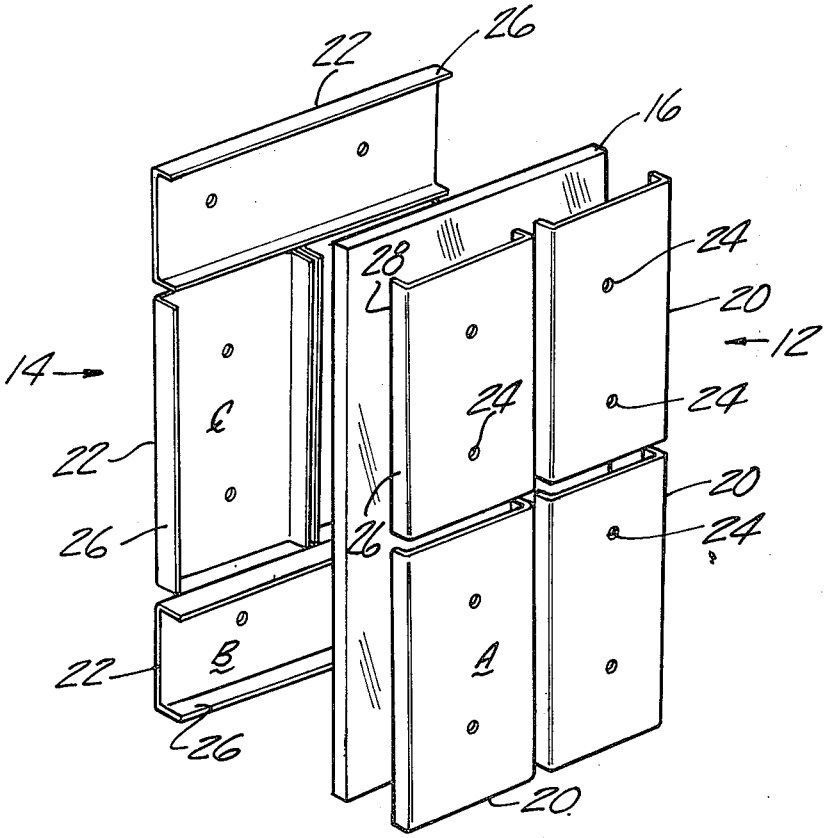
FIG. 3 is an exploded perspective view of electrolytic filter press cell assembly in accordance herewith.

The anode 14 has its rectangular segments 22 oriented such that some extend in the first longitudinal direction and some in a second direction substantially perpendicular to the first direction, as shown. The orientation of the segments of the electrodes is predetermined such that no one segment of either electrode is electrically-mechanically connected to any one segment of the other electrode, completely. Thus, for example, and as shown in FIG. 3, the electrode segment A is electrically-mechanically connected to segments B and C, rather than B or C, alone. By segmenting the electrodes and connecting them such that no one cathode segment is completely connected to an anode segment, across the barrier 16, current distribution problems potentially caused by poor bipolar electrical connections are reduced. Moreover, if one of the bipolar connections should fail in any one cell, the segmentation allows the current to be redistributed through the cell and, thus, avoids propagation of excessive current maldistribution throughout the module.

Furthermore, the use of segmented electrodes provides additional operating advantages in bipolar filter press cells.

Initially, the use of segments, as opposed to a large metal sheet, simplifies assembly of the electrode. Also, the use of segments reduces the tolerance problems normally encountered with single sheet electrodes. Also, each segment requires only two bosses to be aligned with only two holes in the central web or barrier. A single piece electrode must have eight bosses which must line up simultaneously with eight holes in the central barrier.

It should be noted that the segmentation illustrated in the drawing is not the only possible configuration. Rather, any segmentation and orientation whereby at least one boss of each electrode segment is connected to a boss of a different electrode segment than the other bosses on the electrode is effective herein.

Moreover, and in accordance herewith each segment 20 and 22 is substantially rectangular, as hereinbefore noted. Each of the longest edges of each segment includes a right angle bend 26. The bend 26 extends a predetermined distance inwardly toward the central web 16, i.e., in the direction of the boss 18. The predetermined distance of the bend is less than or equal to the thickness of the boss 18, and is, preferably, equal to the thickness of the boss 18.

By providing the bends 26 the edges 28 thereof each bear against the barrier 16. Since the bosses 18, also, bear against the same central barrier continuous support for each electrode segment is, hereby, provided. Moreover, the bends 26 function to stiffen the electrode segments. This enhances the ability to maintain electrode flatness and spacing within the necessary tolerances.

It should be noted that the present invention, while being efficacious in all bipolar electrolytic filter press cells, enjoys particular utility in diaphragm-type bipolar electrolytic filter press cells for the production of chlorine and caustic.

Having, thus, described the invention what is claimed is:

1. In a bipolar filter press cell of the type having an anode and a cathode separated by a central barrier and being electrically-mechanically connected through a boss, the improvement which comprises:

the cathode comprising a plurality of segments, each segment having at least two bosses associated therewith, the anode comprising a plurality of segments, each segment having at least two bosses associated therewith, and wherein the segments are oriented such that at least one boss of each one electrode segment is connected to a boss of a different electrode segment than the other bosses on the one electrode segment.

2. The filter press cell of claim 1 wherein each segment is substantially rectangular.

3. The filter press cell of claim 2 wherein each long edge of each segment has a substantially right angle bend.

4. The filter press cell of claim 3 wherein each bend has a predetermined distance less than or equal to the thickness of the boss.

5. A method for reducing the current differentials in a bipolar filter press cell of the type having an anode and a cathode separated by a central barrier, comprising:

segmenting each electrode into a plurality of segments associating at least two bosses with each electrode segment, and connecting each one segment across the central barrier to another electrode segment through the bosses such that each one segment of one electrode is connected to a boss of a different electrode segment than the other bosses on that one electrode segment.

6. The method of claim 5 wherein each segment is substantially rectangular.

7. The method of claim 6 wherein each long edge of each segment has a substantially right angle bend.

8. The method of claim 7 wherein each bend has a predetermined distance less than or equal to the thickness of the boss.

* * * * *